US010563921B2

(12) United States Patent
Boeberl et al.

(10) Patent No.: US 10,563,921 B2
(45) Date of Patent: Feb. 18, 2020

(54) DELIMITATION FOR REDUCTION OF THE DUST EMISSIONS FOR A COOLER FOR COOLING HOT BULK MATERIAL

(71) Applicant: Primetals Technologies Austria GmbH, Linz (AT)

(72) Inventors: Michaela Boeberl, St. Florian (AT); Stephan Hattinger, Leonding (AT); Stefan Hoetzinger, Wels (AT); Stefan List, Linz (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 135 days.

(21) Appl. No.: 15/565,737

(22) PCT Filed: Mar. 24, 2016

(86) PCT No.: PCT/EP2016/056530
§ 371 (c)(1),
(2) Date: Oct. 11, 2017

(87) PCT Pub. No.: WO2016/165926
PCT Pub. Date: Oct. 20, 2016

(65) Prior Publication Data

US 2018/0120030 A1 May 3, 2018

(30) Foreign Application Priority Data

Apr. 17, 2015 (EP) ..... 15164044

(51) Int. Cl.
*F27D 15/02* (2006.01)

(52) U.S. Cl.
CPC .. *F27D 15/0213* (2013.01); *F27D 2015/0233* (2013.01)

(58) Field of Classification Search
CPC ..... C21B 2100/44; F27D 15/0213; F27D 15/0266; F27D 15/0273; F27D 17/004; F27D 2015/0233
(Continued)

(56) References Cited

U.S. PATENT DOCUMENTS 1,989,662 A * 2/1935 Bernhard ..... F27D 15/0273 110/275
3,170,775 A * 2/1965 Howell, Jr. ..... F27D 15/0213 34/164
(Continued)

FOREIGN PATENT DOCUMENTS

CN 202372014 * 8/2012 ..... F27D 15/0213
CN 202372014 U 8/2012
(Continued)

OTHER PUBLICATIONS

CN202372014 (Espacenet english machine translation version) Xiangpei et al., smoke cover liquid sealing device and circular-cooling machine with same, Aug. 8, 2012, Bibilography (1, page), Description (pp. 1-5), Claims (pp. 1-2) (Year: 2012).*
(Continued)

*Primary Examiner* — Jessee R Roe
*Assistant Examiner* — Michael Aboagye
(74) *Attorney, Agent, or Firm* — Ostrolenk Faber LLP

(57) ABSTRACT

A cooler (1) for cooling hot bulk goods (17) preferably iron ore sinter: The cooler has a grate surface (16) for holding the hot bulk goods (17) to be treated to reduce the dust emissions and at the same time to also enable maintenance measures on the cooler (1). Covers are located in the region of the feed point (2) and the removal point (3). The device herein provides an additional boundary, which prevents the removal of dust particles of size over 150 μm. The boundary is a stationary first wall (12) and a stationary second wall
(Continued)

(11) and the boundary extends over a partial segment, and preferably over the entire region, of the uncovered grate surface (16). A supporting structure (18) is provided, to which the first wall (11) and the second wall (12) are fastened.

13 Claims, 6 Drawing Sheets

(58) Field of Classification Search
USPC ..... 266/279; 432/241, 77, 78, 85; 110/327, 110/328, 270, 288, 268; 34/237, 164, 34/216, 236; 126/152 R, 163 R, 171, 126/172, 174
See application file for complete search history.

(56) References Cited

U.S. PATENT DOCUMENTS 3,374,553 A * 3/1968 Gillman ..... F27D 15/022 110/328
3,704,873 A * 12/1972 Jensen ..... F27B 7/40 34/135

FOREIGN PATENT DOCUMENTS

| | | | |
|---|---|---|---|
| CN | 203274519 | U | 11/2013 |
| CN | 203949515 | U | 11/2014 |
| EP | 0 127 215 | B1 | 11/1986 |
| JP | S58-61241 | | 4/1983 |
| JP | S58-74096 | | 5/1983 |
| JP | S60-127351 | | 8/1985 |
| JP | H02-33249 | | 3/1990 |
| JP | H07-167565 | | 7/1995 |
| JP | 2013-002782 | A | 1/2013 |

OTHER PUBLICATIONS

International Search Report dated Jun. 27, 2016 in corresponding PCT International Application No. PCT/EP2016/056530.
Written Opinion dated Jun. 27, 2016 in corresponding PCT International Application No. PCT/EP2016/056530.
Search Report dated Sep. 28, 2015 in corresponding European Patent Application No. 15164044.8.
Office Action dated Sep. 10, 2018 in corresponding Chinese Patent Application No. 201680022503.6.
Japanese Office Action dated Mar. 11, 2019 issued in Japanese Patent Application No. 2017-554308 with an English language translation.

* cited by examiner

PRIOR ART

PRIOR ART

DELIMITATION FOR REDUCTION OF THE DUST EMISSIONS FOR A COOLER FOR COOLING HOT BULK MATERIAL

CROSS-REFERENCE TO RELATED APPLICATIONS

The present application is a 35 U.S.C. §§ 371 national phase conversion of PCT/EP2016/056530, filed Mar. 24, 2016, which claims priority of European Patent Application No. 15164044.8, filed Apr. 17, 2015, the contents of which are incorporated by reference herein. The PCT International Application was published in the German language.

FIELD OF THE INVENTION

The present invention relates to the field of metallurgical plants, specifically in the iron industry, for the cooling of hot bulk material.

BACKGROUND OF THE INVENTION

The invention relates to a cooler for cooling hot bulk material in the iron industry. The cooler comprises:

- a grate surface for accommodating the hot bulk material for treatment,
- a first cooler wall and a second cooler wall which delimit the grate surface to the right and to the left,
- a feeding-in point for the hot bulk material,
- a first region which takes up between 20% and 30% of the grate surface, the first region comprises the feeding-in point, and the first region has a fixedly positioned first cover,
- a second region which opens upwardly and which is situated between the first region and a third region,
- an extraction point for the cooled bulk material,
- a third region, which extends over at least 10% to 20% of the grate surface, wherein the third region comprises the extraction point and has a fixedly positioned third cover.

PRIOR ART

It is known to cool bulk material on coolers which convey the bulk material in a continuous fashion. The continuous conveyance may take place in a straight line or in a circuit. A machine of this type is a ring-shaped machine, disclosed in EP0127215B1. The machine has a ring-shaped grate surface. Hot bulk material is loaded onto the grate surface at a feeding-in point During a rotation, a cooling gas, in particular cooling air, is blown through by blower boxes arranged below the grate. The cooled bulk material is discharged again at an extraction point which is situated immediately adjacent to the feeding-in point.

During operation of a machine of this type, very high dust emissions are generated. To control this, covers and dust-removal devices are provided in the region of the feeding-in and extraction points. The greatest dust emissions occur in the region. Dust emissions also occur in the remaining region of the ring-shaped machines, caused by cooling air being blown through, such that dust emissions arise which increase the dust content in the air.

At present, it is common for only approximately 30-50% of the ring-shaped grate surface to be covered. Gas-tight coverage of the entire grate surface, such as is disclosed in EP0127215B1, is normally not implemented because, in this way, the entire gas quantity would have to be extracted and subjected to dust removal treatment. The gas quantity would be 1.5-2 times as great as the process gas quantity. This would lead to high investment costs for the dust removal, due to large blower and filter sizes. A further disadvantage of that known embodiment is that the maintenance of the ring-shaped machine is highly cumbersome. Owing to the gas-tight cover, it is highly cumbersome to perform maintenance operations. The dismounting and subsequent mounting of the gas-tight cover is highly cumbersome. The sealing capability of the cover must be restored every time in order that no undesired gases or solid particles may be drawn in from the outside, which would additionally increase the gas quantity to be subjected to dust removal treatment.

SUMMARY OF THE INVENTION

It is the object of the present invention to provide a device which first reduces the dust emissions and secondly allows maintenance operations on the cooler to be performed easily and in a short time.

That object is achieved by use of the cooler mentioned in the introduction wherein the second region has a delimitation comprised of a positionally fixed first wall and of a positionally fixed second wall. The delimitation extends at least over a partial section of the second region, and preferably over the entire second region. For this purpose, the first wall and the second wall are suspended on a supporting structure, the first wall lies on the first cooler wall or is separated from the first cooler wall by a gap, and the second wall lies on the second cooler wall or is separated from the second cooler wall by a gap, wherein the delimitation is comprised of individual segments.

This wall arrangement prevents dust situated on the grate surface from being entrained by the cooling gas or by external wind influence. In this context, "lies on" or "separated by a gap" means that the movement of the cooler is not impeded by excessive friction between the walls. A possible gap should be as small as possible in order to prevent escape of dust particles. The outlet speed of the cooling gas from the bulk material situated on the grate surface causes particles to be carried along by the cooling gas.

The dust removal at the feeding-in point already removes a major part of the dust particles, which have a size of less than 150 μm. The cooler according to the invention has surprisingly been found to again deposit dust particles, which are larger than 150 μm and which rise owing to the cooling air, predominantly on the grate surface or on the bulk material situated thereon. The first wall and the second wall prevent the entrained particles from being carried away by external wind influence or by the cooling gas. "External wind influence" to mean, for example, a side wind which acts on the cooler transversely to the movement direction. In the case of a ring-shaped cooler, the side wind may also act, in part, in the direction of movement and due to the circular form of the cooler may carry away the particles beyond the grate surface. The height of the side walls is coordinated with the outlet speed of the cooling gas out of the bulk material. An outlet speed of the cooling gas from the bulk material of 2 m/s yields a height of the delimitation of 1.8 m. The height of the delimitation refers to the height measured from the upper edge of the bulk material to the upper edge of the first wall or the second wall. The first and the second wall are preferably of equal height.

The first wall and the second wall are arranged to be positionally fixed, and the cooler is designed to be movable. "Movable" means that a continuous conveying action is involved, which may be in a circuit or in a straight line. To first ensure the best possible sealing between the first cooler wall and the second cooler wall and the first wall and the second wall, and to secondly ensure that the mobility is not unduly impeded by high friction forces, a supporting structure is provided, on which the first wall and the second wall are suspended. The supporting structure is designed such that fast dismounting of the delimitation is possible. It is not necessary, as shown in the prior art, for the gas sealing action to be restored. By way of the delimitation, the amount of diffusely emitted dust is greatly reduced.

The delimitation should extend over a part of the second region, and preferably over the entire second region. To permit maintenance work on the cooler without the need to dismount the delimitation, in sum total, the first cover, third cover and the delimitation encompass between 80% and 95% of the grate surface. To achieve the greatest effect for reduction of dust emissions, the first cover, the third cover and the delimitation encompass the entire grate surface.

The delimitation is comprised of individual segments. The cooler must undergo maintenance at regular intervals. During maintenance, individual components of the cooler are exchanged. To make it possible for this to be performed easily and in a short time, the delimitation is comprised of multiple segments, which are assembled using an easily releasable connection, for example a screw connection or a bolted connection.

Each individual segment is each comprised of a first wall and second wall which correspond to the segment size. A segment may additionally have a perforated plate. After the release of the connection between a segment and the supporting structure, it is possible for the respective segments of the delimitation to be raised as a whole, or for the first wall and/or the second wall and/or the perforated plate of the segment to be removed. Here, the segments may be of different sizes. One possible variant is for the delimitation to be comprised only of two segments, a large segment, which is removed only in exceptional circumstances, and a relatively small segment, which is removed for maintenance purposes. To minimize manufacturing outlay, a preferred solution is for all of the segments to be manufactured of the same size.

In one advantageous embodiment of the ring-shaped cooler, the delimitation has a height, measured between a top edge of the bulk material and a top edge of the first wall or the second wall, of at least 1 m, preferably 1.5 m, particularly preferably 2.0 m, very particularly preferably 2.5 m. The height between the top edge of the bulk material and the top edge of the first wall or the second wall influences the result of the reduction of the dust emissions. If the top edge of the first wall or of the second wall were situated only a few tens of centimeters above the bulk material, the effect for the reduction of the dust emissions would be only very slight. Therefore, the delimitation should have a minimum height of 1 m. This gives rise to the desired effect, whereby the dust particles are deposited on the grate surface again. No significant further reduction in dust emissions is perceptible in the case of a spacing of over 2.5 m.

In one design variant, the delimitation to additionally has a perforated plate which is situated between the first wall and the second wall so as to be situated above and opposite the grate surface, and preferably substantially parallel to the grate surface. "Substantially parallel" encompasses angle deviations of up to ±10°. As seen in FIG. 4, the perforated plate is at a height spaced above the top edge of the bulk material.

The perforated plate additionally improves the reduction of dust emissions. The perforated plate ensures firstly that dust particles which would be carried away beyond the delimitation are retained, and secondly that the cooling gas that is provided can emerge uniformly over the entire grate surface. A "perforated plate" comprises a plate comprised, for example, of sheet steel. The plate may have holes, other punched-out portions or openings which enable the cooling gas to flow through. A further example of a perforated plate is a lattice grate. The perforated plate is situated between the first wall and the second wall.

In a design variant, a temperature-resistant seal is fitted at the transition from the first cooler wall to the first wall and at the transition from the second cooler wall to the second wall.

A temperature-resistant seal of this type may for example be comprised of a fabric, or may also be in the form of a brush seal. In this context, "temperature resistance" relates to a temperature up to 600° C. The seals may be fitted on the outer side of the second wall and the first wall, that is not on the side which faces toward the hot bulk material and/or on the inner side, which faces toward the bulk material.

In a further advantageous embodiment, the perforated plate has perforations occupying up to 70%, preferably up to 60%, very particularly preferably up to 50%, of the total area of the perforated plate. It has been found that perforations occupying the plate in a range from 50% to 70% yield the best results reduction of the dust emissions and the outflow of the cooling gas.

In an advantageous embodiment, the perforated plate is formed from expanded metal. An expanded metal has excellent characteristics with regard to its nature in terms of the openings, strength and weight. First, the dust emissions are reduced to a minimum, and secondly the cooling gas can flow out uniformly over the entire area. The relatively low weight has a positive effect on the supporting structure, because that structure can be designed for lower loads.

In an advantageous embodiment, the cooler is in the form of a ring-shaped cooler. A ring-shaped cooler can be of more compact construction in order to accommodate the same amount of bulk material. A further major advantage of a ring-shaped cooler is that virtually the entire grate surface is loaded with bulk material which can thus be cooled. In the case of a straight cooler, the grate surface that moves from the extraction point to the feeding-in point is not loaded. It is therefore always only possible for approximately half of the grate surface to be utilized. In contrast to a straight cooler, in a ring-shaped cooler, only half of the grate surface is required for the same amount of bulk material to be cooled.

In a ring-shaped cooler, the delimitation is particularly advantageous because it is always possible for the particles to be carried away by wind influence from all directions. The circular embodiment causes the problem of entrainment by wind influence to always exist. There is no single wind direction that is particularly critical or particularly non-critical.

A further design variant of the ring-shaped cooler provides for the individual segments to have an angle of at least 10° and at most 20° of the ring shape. The size is selected such that maintenance can be performed on the ring-shaped cooler, and the delimitation can be removed with manageable outlay and in a short time.

In one possible use of the cooler, the hot bulk material is iron ore sinter or manganese ore sinter, the coolers according to the invention are frequently used for cooling iron ore sinter and manganese ore sinter.

BRIEF DESCRIPTION OF THE DRAWINGS

The present invention will be described by way of example below on the basis of schematic Figures, in which.

DESCRIPTION OF PRIOR ART EMBODIMENTS

Figure 1:
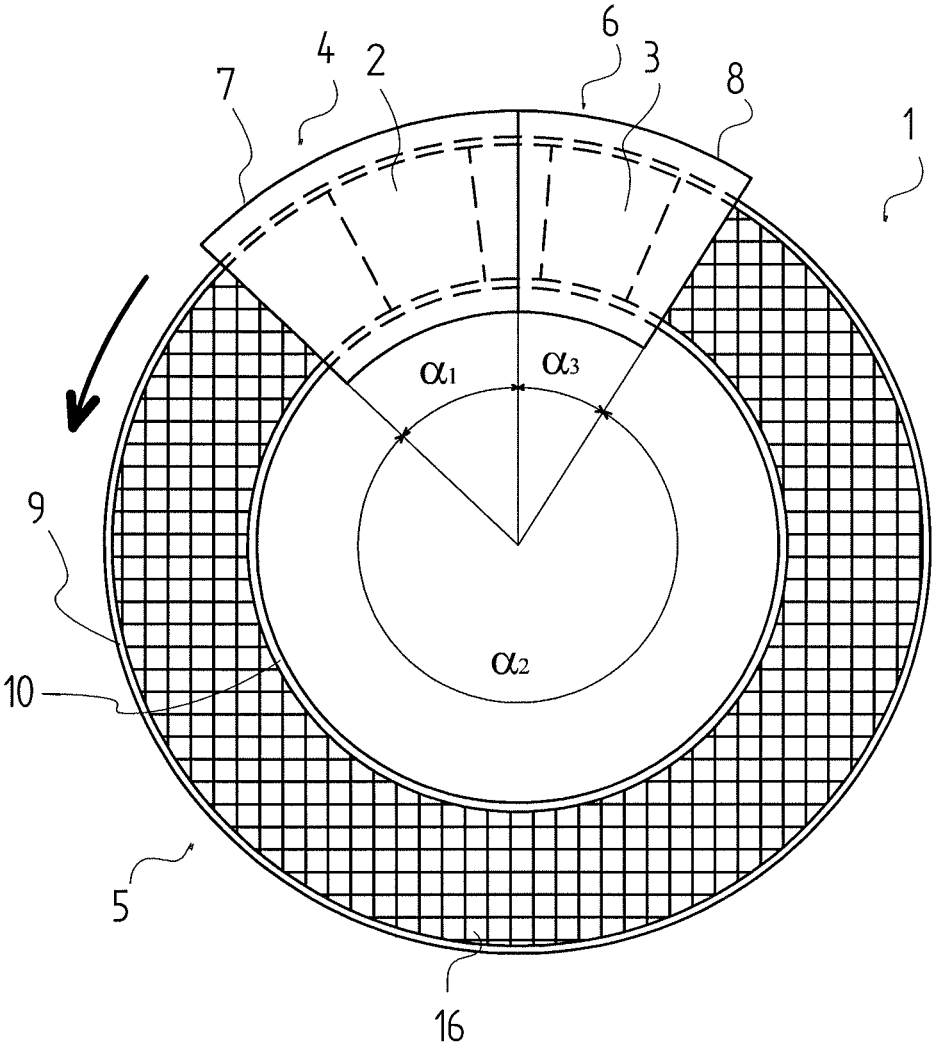
FIG. 1 is a schematic illustration of a ring-shaped cooler according to the prior art.

FIG. 1 shows a plan view of a ring-shaped cooler 1. It has a feeding-in point 2, which is situated in a first region 4. It has a cover 7 situated over the first region 4. The first region 4 encompasses a region denoted by the angle $\alpha_1$. The first region 4 is followed in the direction of rotation, which is indicated by the arrow, by a second region 5. The second region 5 does not have a cover. The ring-shaped cooler 1 has a grate surface 16 which is delimited by a first radially inward cooler wall 10 and by a second radially outward cooler wall 9. The second region can accommodate hot bulk material. The size of the second region 5 is indicated by the angle $\alpha_2$.

A third region 6 is situated between the other two regions 4 and 5. The discharge point 3 and a third cover 8 are also situated in the third region 6. The size of the third region 6 is indicated by the angle $\alpha_3$. In the case of a ring-shaped cooler, the first cooler wall 10 corresponds to a cooler inner wall, and the second cooler wall 9 corresponds to a cooler outer wall.

Figure 2:
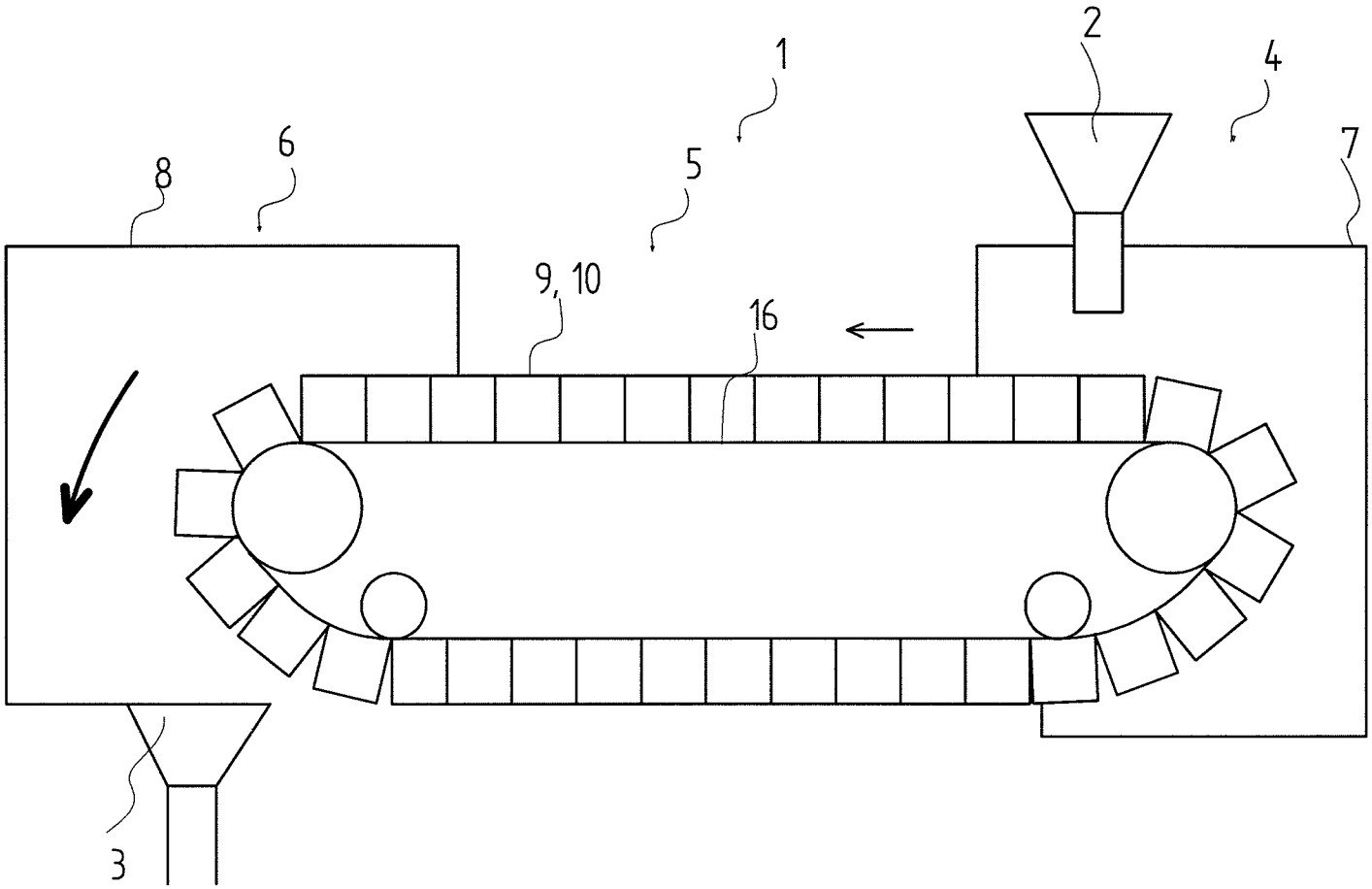
FIG. 2 is a schematic illustration of a straight cooler according to the prior art.

FIG. 2 shows a side view of a straight cooler 1. A feeding-in point 2 is situated in a first region 4, and a cover 7 is situated over the first region 4. The first region 4 is followed in the direction of movement, indicated by the arrow, by a second region 5. The second region 5 does not have a cover. The straight cooler 1 has a grate surface 16 which is delimited by a first cooler wall 10 and by a second cooler wall 9 and which can accommodate hot bulk material. A third region 6 follows the second region 5 in an adjoining manner. The discharge point 3 and a third cover 8 are also situated in the third region 6.

DESCRIPTION OF EMBODIMENTS

Figure 3:
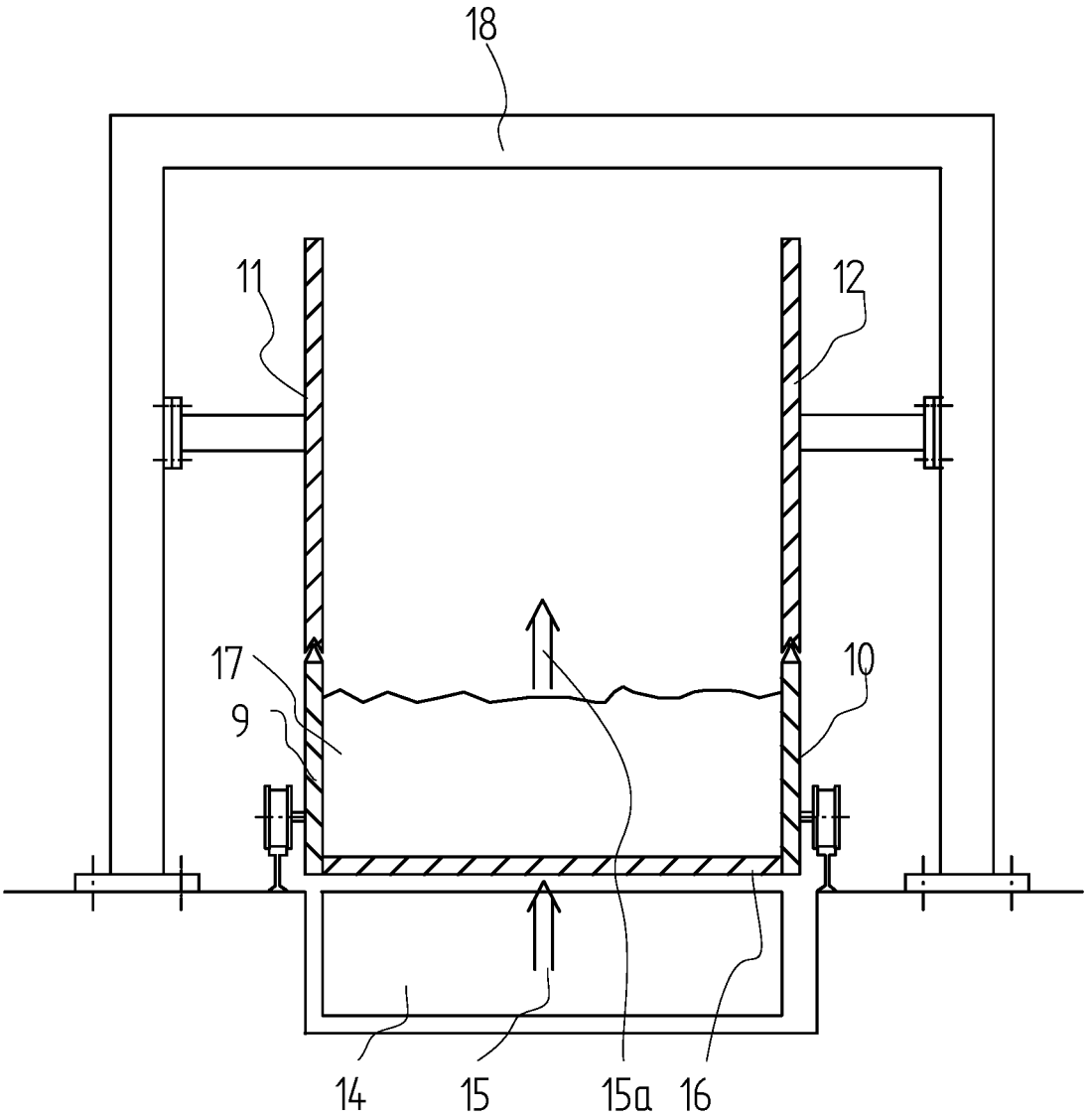
FIG. 3 is a schematic illustration of a cooler according to the invention.

FIG. 3 illustrates an embodiment according to the invention of the device for reducing the dust emissions in a ring-shaped cooler.

The hot bulk material 17 is situated on the grate surface 16. That surface is delimited by the second cooler wall 9 and the first cooler wall 10. A second wall 11 is situated on the second cooler wall 9, and a first wall 12 is situated on the first cooler wall 10. Cooling air 15 is blown through the grate surface 16 and through the hot bulk material 17 by action of a blower box 14. The cooling air 15*a* emerges at the surface of the bulk material 17, carrying along dust particles. The first wall 12 and the second wall 11 are fastened to a supporting structure 18, in order that the rotational movement of the ring-shaped cooler 1 not impeded by the weight of the first wall 12 and second wall 11, and in order that dismounting can be performed quickly. Dismounting the second wall 11 and the first wall 12 is necessary for maintenance of the ring-shaped cooler.

Figure 4:
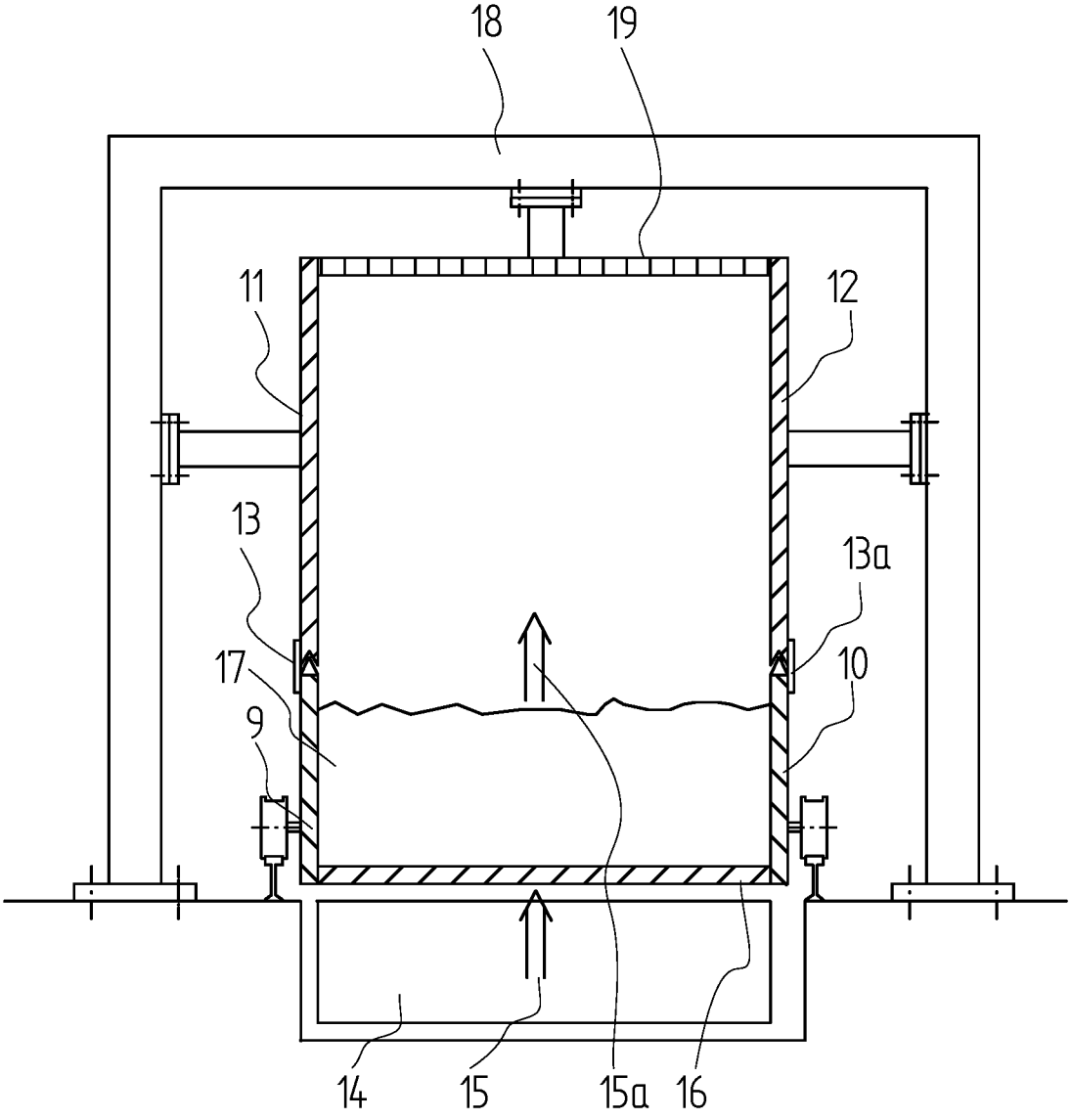
FIG. 4 shows an advantageous design variant of a cooler according to the invention.

FIG. 4 illustrates an advantageous design variant of a ring-shaped cooler according to the invention. That variant differs from FIG. 3 in that a perforated plate 19 is installed between the second wall 11 and the first wall 12. Furthermore, a temperature-resistant seal 13, 13*a* is arranged at the transition between the first cooler wall 10 and the first wall 12 and between the second cooler wall 9 and second wall 11. The seal 13, 13*a* prevents dust particles from escaping from the cooler via that transition path. The reference designations not mentioned here have been described with regard to FIG. 3.

Figure 5:
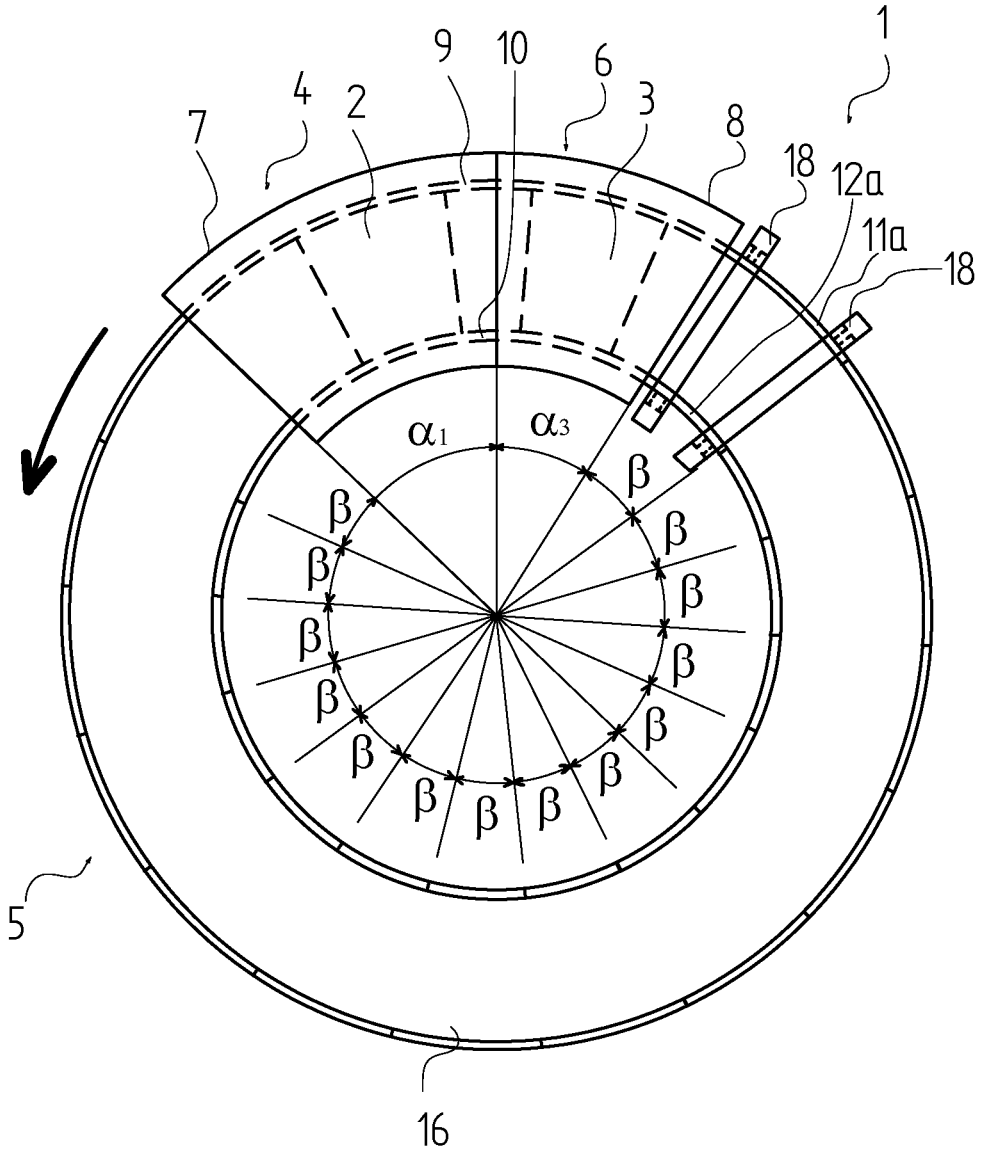
FIG. 5 shows an advantageous design variant of a ring-shaped cooler according to the invention.

FIG. 5 a further advantageous embodiment of the ring-shaped cooler according to the invention, in which the first wall 12*a* and the second wall 11*a* are comprised of individual segments. The annular sizes of the individual segments are indicated by the angle $\beta$. In this embodiment, all of the segments may be of equal size. The segments of the second wall 11*a* and of the first wall 12*a* are each suspended on the supporting structure 18. In this Figure, a supporting structure is illustrated only for one segment. A segment is comprised in each case of a first wall 12*a*, a second wall 11*a* and, if one is provided, a perforated plate. The perforated plate has not been illustrated in this Figure in order to provide a clearer illustration. The reference designations not mentioned here have already been described with regard to FIG. 3.

Figure 6:
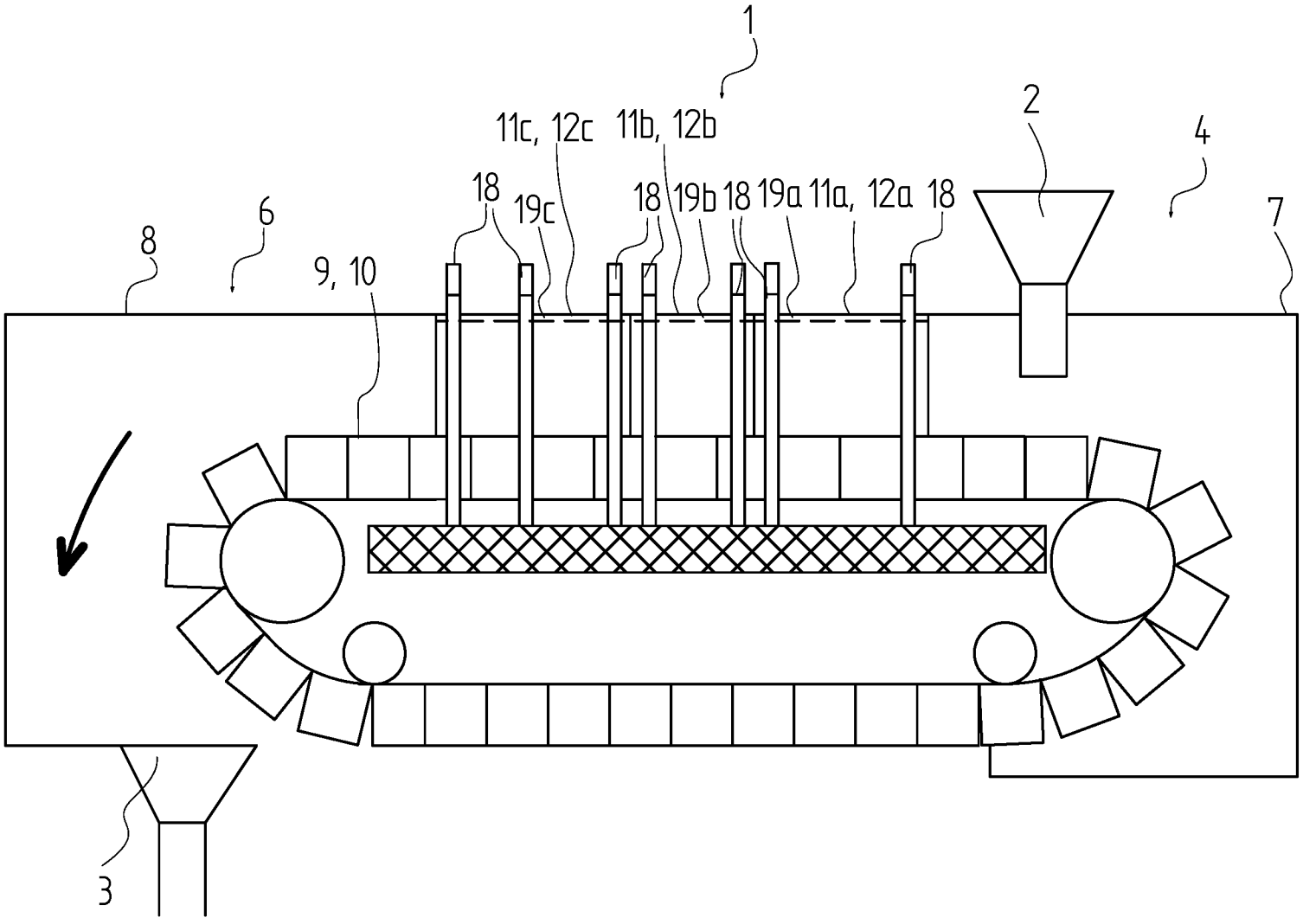
FIG. 6 is a schematic illustration of a straight cooler according to the invention.

FIG. 6 shows a side view of an advantageous embodiment of a straight cooler 1 according to the invention. Here, the first wall 12*a-c* is arranged on the first cooler wall 10 and the second wall 11*a-c* is arranged on the second cooler wall 9. The first wall 12*a-c* and the second wall 11*a-c* are suspended from the supporting structure 18, and a perforated plate 19*a-c* is also fitted. In this illustration, the division into segments of the first wall 12*a*, 12*b* and 12*c*, of the second wall 11*a*, 11*b* and 11*c* and of the perforated plate 19*a*, 19*b* and 19*c* can be seen. It is thus always possible to remove specifically those parts, that is the three segments that have to be removed in order to be able to perform maintenance operations. The reference designations not mentioned here have already been described with regard to FIG. 3.

Even though the invention has been illustrated and described in more detail on the basis of the preferred exemplary embodiments, the invention is not restricted to the disclosed examples, and other variations may be derived from these by a person skilled in the art, without departing from the scope of protection of the invention.

LIST OF REFERENCE DESIGNATIONS

1 Cooler
2 Feeding-in point
3 Extraction point
4 First region
5 Second region
6 Third region
7 First cover
8 Third cover
9 Second cooler wall
10 First cooler wall
11, 11*a-c* Second wall
12, 12*a-c* First wall
13, 13*a* Seal
14 Blower box
15 Cooling gas entering the grate surface
15*a* Cooling gas exiting the bulk material
16 Grate surface
17 Bulk material

18 Supporting structure
19, 19*a-c* Perforated plate
$\alpha_1$ Angle of first region
$\alpha_2$ Angle of second region
$\alpha_3$ Angle of third region
$\beta$ Size of the segments

The invention claimed is:

1. A cooler for cooling hot bulk material, comprising:

a grate surface configured for supporting the hot bulk material for treatment;

a first cooler wall and an opposing second cooler wall spaced apart to delimit the grate surface between the first and second cooler walls;

a feeding-in point for feeding the hot bulk material to the grate surface;

a first region that extends over between 20% and 30% of the grate surface, wherein the first region comprises the feeding-in point;

a positionally fixed first cover over the first region;

a second region that is upwardly open and is situated between the first region and a third region;

an extraction point for the cooled bulk material;

the third region that extends over at least 10% to 20% of the grate surface, wherein the third region comprises the extraction point;

a positionally fixed third cover over the third region;

a delimitation at the second region comprised of a positionally fixed first wall that comprises a plurality of individual segments, and a positionally fixed second wall comprising a plurality of individual segments and spaced from the positionally fixed first wall, and the delimitation extends at least over a partial section of the second region;

a supporting structure on which the positionally fixed first wall and the positionally fixed second wall are suspended, the positionally fixed first wall lies on the first cooler wall or is separated from the first cooler wall by a gap, and the positionally fixed second wall lies on the second cooler wall or is separated from the second cooler wall by a gap;

and the delimitation additionally has a perforated plate comprising a plurality of individual segments situated between the positionally fixed first wall and the positionally fixed second wall.

2. The cooler as claimed in claim 1, wherein the delimitation has a height, measured between a top edge of the bulk material at the grate surface and a top edge of the positionally fixed first wall or a top edge of the positionally fixed second wall, of at least 1 m.

3. The cooler as claimed in claim 1, further comprising:

a transition from the first cooler wall to the first wall, and a respective temperature-resistant seal is fitted at the transition from the first cooler wall to the first wall;

a transition from the second cooler wall to the second wall, and a respective temperature resistant seal is fitted at the transition from the second cooler wall to the second wall.

4. The cooler as claimed in claim 1, wherein the perforated plate has perforations occupying up to 70% of a total area of the perforated plate.

5. The cooler as claimed in claim 1, wherein the perforated plate is formed from expanded metal.

6. The cooler as claimed in claim 1, wherein the cooler is in the form of a ring-shaped cooler.

7. The cooler as claimed in claim 6, wherein the individual segments of the ring-shaped cooler extend over an angle of the ring shape in the range of 10° to 20°.

8. The cooler as claimed in claim 1, wherein the delimitation has a height, measured between a top edge of the bulk material and a top edge of the positionally fixed first wall or of the positionally fixed second wall of at least 1.5 m.

9. The cooler as claimed in claim 1, wherein the delimitation has a height, measured between a top edge of the bulk material and a top edge of the positionally fixed first wall or of the positionally fixed second wall of at least 2.0 m.

10. The cooler as claimed in claim 1, wherein the perforated plate has perforations occupying up to 60% of a total area of the perforated plate.

11. The cooler as claimed in claim 1, wherein the perforated plate has perforations occupying up to 50% of a total area of the perforated plate.

12. The cooler as claimed in claim 1, wherein the cooler is in the form of a straight path cooler.

13. The cooler as claimed in claim 2, wherein the perforated plate is at a height which is to be above the top edge of the bulk material at the grate surface.

* * * * *